US005248954A

United States Patent [19]

Chiang

[11] Patent Number: 5,248,954

[45] Date of Patent: Sep. 28, 1993

[54] CIRCUIT PROTECTING DEVICE

[76] Inventor: Huan-Chang Chiang, 87 Buh-tzyy Lane, Taichung City, Taiwan

[21] Appl. No.: 981,802

[22] Filed: Nov. 25, 1992

[51] Int. Cl.[5] ..... H01H 71/58; H01H 61/00

[52] U.S. Cl. ..... 337/66; 337/68; 337/91

[58] Field of Search ..... 337/68, 91, 66

[56] References Cited

U.S. PATENT DOCUMENTS 3,846,729 11/1974 Sorimachi ..... 337/91
4,068,203 1/1978 Unger ..... 337/91
4,868,535 9/1989 Janniere et al. ..... 337/66

*Primary Examiner*—Harold Broome
*Attorney, Agent, or Firm*—Pro-Techtor International

[57] ABSTRACT

A circuit protecting device somprises mainly a housing, an insulation piece, a bimetallic blade, a spring and a press button. The housing has a cover and a main body provided with two partition blocks forming a spring slot and a press button slot communicating with the spring slot. The bimetallic blade has an end fastened to one of two terminals and has another end provided with a contact piece in contact with another one of the two terminals. The spring embracing the outer end of the insulation piece is received in the spring slot of the main body of the housing while the press button is received in the press button slot of the main body of the housing. The inner end of the press button is provided with an insertion hole for receiving therein the outer end of the insulation piece. When a current overload takes place, the heat so generated causes the bimetallic blade to deform so as to force the press button to move outwards until two restrictive flanges of the press button are obstructed by two arresting portions located at the port of the press button slot of the main body of the housing.

4 Claims, 4 Drawing Sheets

CIRCUIT PROTECTING DEVICE

BACKGROUND OF THE INVENTION

The present invention relates to a circuit, and more particularly to a circuit protecting device capable of interrupting effectively and stably the flow of an electric current at such time when an overload of the electric current takes place.

An overload protective device installed on an electric circuit is for use in preventing a fire, as when the flow of the electric current becomes excessive. A protective device of the bimetallic type is superior to those of the fuse type and the electromagnetic type, in view of the facts that the bimetallic type has no such component part as the fuse that gets burned out and has to be replaced, and that the operation of the component parts of the bimetallic type is smoother than the electromagnetic type, and further that the bimetallic type can be made at a lower cost.

As disclosed in the U.S. Pat. No. 4,363,016 issued to Unger, the prior art electric circuit breaker of the bimetallic type is composed mainly of a slide member 18, a bimetallic blade 35, a spring 25 and a rocker button 24. The bimetallic blade 35 has an end that is fastened securely on a terminal 17 and has another end having thereon a contact 21 which is in contact with a contact 20 of another terminal 16 via an opening 55 of the slide member 18, which has a hollow head portion 58 intended for a trunnion 74 of the rocker button 24 of fit thereinto. The rocker button 24 is coupled with an end of the spring 25 which has another end urging a partition wall 45 of a case 11. The slide member 18 is held securely in place by means of the contact 21 of the bimetallic blade 35 via the opening 55. The distortion of the bimetallic blade 35 causes the contact 21 to move away from the opening 55 at such time when an excessive temperature is generated by a current overload. As a result, the rocker button 24 and the slide member 18 are forced out by the elastic force of the spring 25 until a stop pin 49 urges a partition wall 44. Since the spring 25 is not in alignment with the slide member 18, the spring 25 is subjected to bending. Therefore, the operational efficiency and the service life span of the spring 25 are greatly undermined. In addition, the spring 25 is often dislodged easily during the installation thereof, in view of the fact that the spring 25 urges only the rocker button 24 and is therefore exerted upon by a deviating compression. Moreover, the hollow head portion 58 of the slide member 18 and the rocker button 24 are so structurally complicated as to increase substantially the cost of the molding tools which are used to make the slide member 18 and the rocker button 24.

Another category of the prior art circuit breaker of the bimetallic type is disclosed in the Taiwanese Patent 120840, which overcomes the shortcoming of the circuit breaker of the U.S. Pat. No. 4,363,016 that the spring is not aligned with the slide member. However, the second prior art circuit breaker has a spring 3 that is mounted in a spring slot 23 of an insulation piece 2 in such a manner that the spring 3 is retained securely in place by two protruded columns 24 located respectively at both ends of the spring slot 23. When a contact point 54 of a tongue 53 of an elastic guide piece 5 is put through an opening 22 of the insulation piece 2, the spring 3 often fails to descend along with the insulation piece 2. However, the protruded column 24 located at the lower end of the spring slot 23 descends along with the insulation piece 2, thereby releasing the spring 3. The spring 3 can easily jump out of the spring slot 23, in view of the fact that the bottom end of the spring 3 is no longer restrained by the partition piece 14 at such time when the distortion of the elastic guide piece 5 induced by a current overload causes the contact point 54 to move away from the opening 23.

SUMMARY OF THE INVENTION

It is, therefore, the primary objective of the present invention to provide a circuit protecting device, which is composed of a housing, an insulation piece, a bimetallic blade, a spring, and a press button. The housing comprises a main body and a cap. Located at one end of the housing are two terminals and the bimetallic blade which has an end that is fastened to a terminal and which has another end that has a contact piece in contact with another terminal via an opening of the insulation piece. The housing is provided with a space formed by two partition blocks so as to form a spring slot and a press button slot in communication with the spring slot. The press button is provided with a press block relative in shape to the press button slot. The both ends of the press button are provided respectively with a restrictive flange and a terminal slot. The press button slot is provided at the outer edge thereof with a slot port having an arresting portion. A compression spring is arranged in the spring slot in such manner that the compression spring is fitted over the end of the insulation piece which is inserted into the press button terminal slot. As a result, the press button is disposed in the press button slot, with its outer end extending out of the slot port and with its inner end urged by the compression spring. When a current overload takes place, a heat is generated to cause the bimetallic blade to distort to move away from the opening. With the help of an elastic force of the spring, the insulation piece urges the press button to move upwards until the restrictive flange of the press button presses against the arresting portions of the slot port. The circuit protecting device of the present invention is structurally simple and highly effective.

It is another objective of the present invention to provide a circuit protecting device, which has a press button with a terminal slot provided radially with one or more nail holes piercing through the press button and with one or more through holes for locating the nails for use in fastening the press button to an end of the insulation piece.

It is still another objective of the present invention to provide a circuit protecting device with a means capable of fastening securely the press button to the insulation piece. The press button is provided with a terminal slot intended to receive the insulation piece having an upper surface and a lower surface, which are toothed like a ratchet for enhacning the coupling of the press button and the insulation piece.

It is still another objective of the present invention to provide a circuit protecting device with a press button having a terminal slot provided radially with one or more inverted retaining holes piercing through the press button. In addition, the circuit protecting device is provided with an insulation piece having one or more unidirectional bevel retainer corresponding in number to the inverted retaining holes and opposite in location to the inverted retaining holes. Furthermore, the insulation piece is provided with a body portion having a notch facilitating the entry of the insulation piece into the terminal slot of the press button so that the unidirectional bevel retainers of the insulation piece are held in the inverted retaining holes of the press button. In other words, the present invention affords a simple way by which the press button is coupled securely with the insulation piece.

The foregoing objectives, features, structures and functions of the present invention will be better understood by studying the following detailed description of the present invention, in conjunction with the drawings provided herewith.

DETAILED DESCRIPTION OF THE PREFERRED EMBODIMENT

Figure 1:
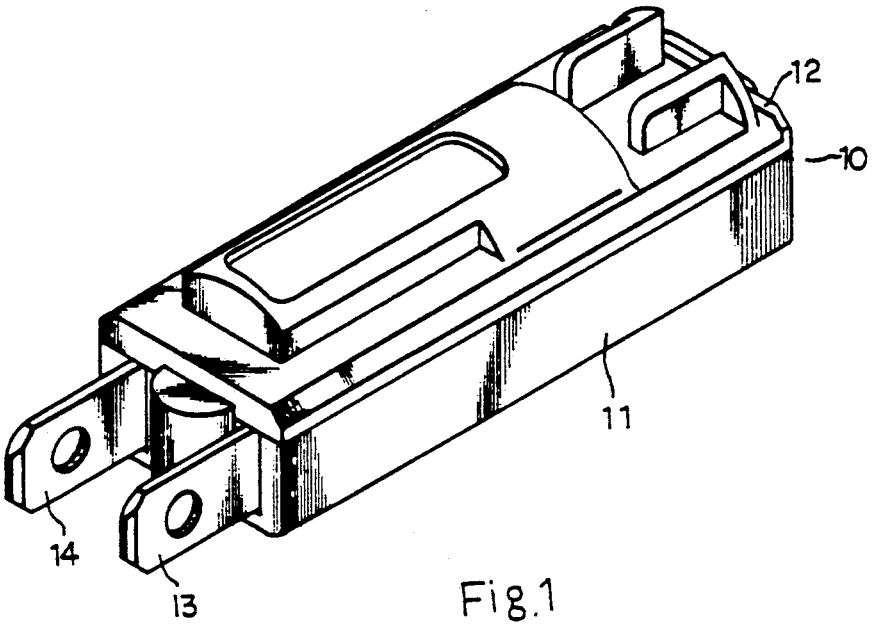
FIG. 1 shows an external schematic view of the present invention.
Figure 2:
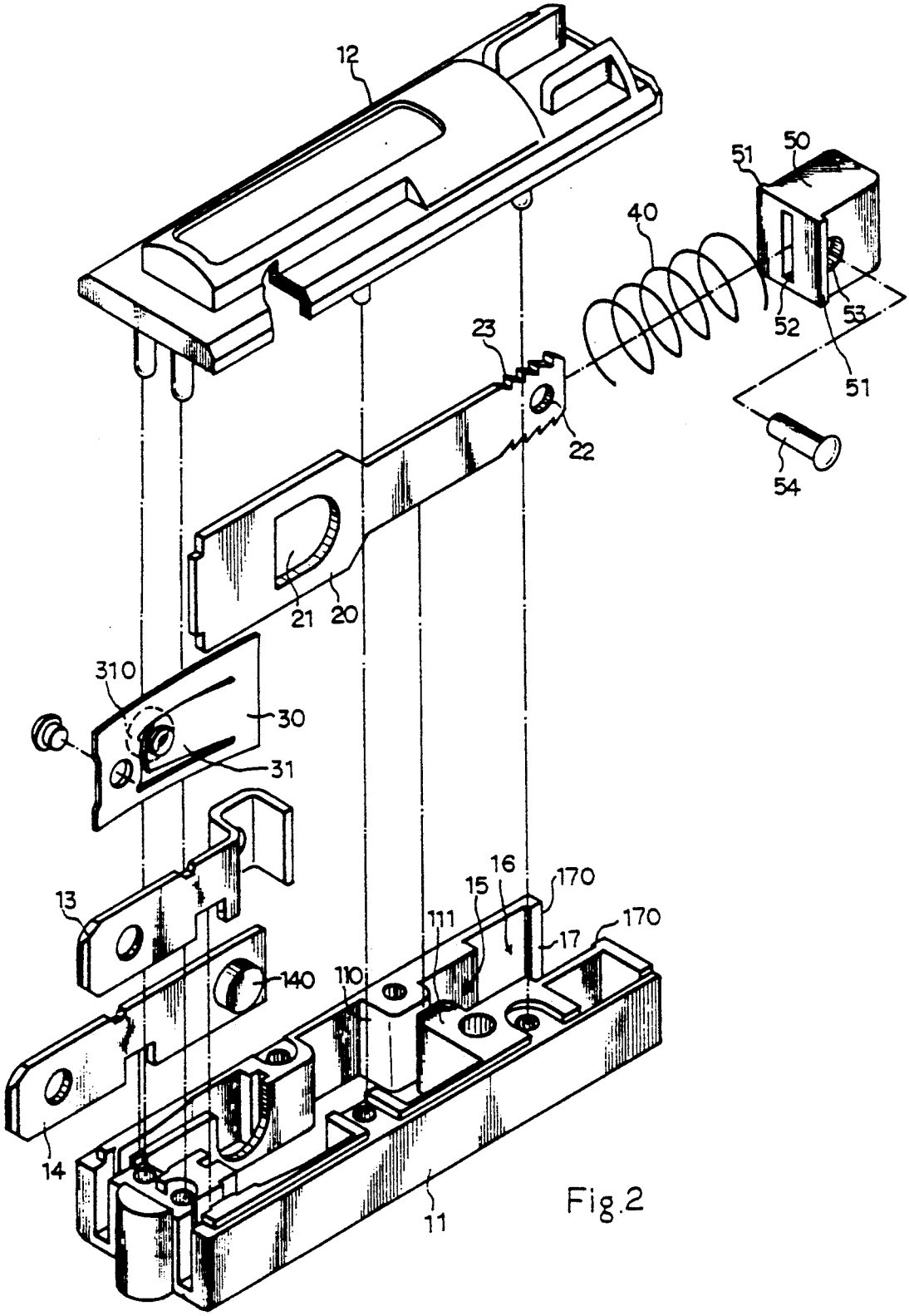
FIG. 2 shows an exploded view of the present invention.

Referring to FIG. 1 and 2, a circuit protecting device of the present invention is shown to comprise a housing 10, an insulation piece 20, a bimetallic blade 30, a spring 40, and a press button 50. The housing 10 is composed of a main body 11 and a cap 12. In addition, the housing 10 contains therein two terminals 13 and 14, which are parallel to each other and extend out of the housing 10. The bimetallic blade 30 has an end that is fastened securely to the terminal 13 and has another end provided with a contact piece 31 having a contact 310 which passes through an opening 21 of the insulation piece 20 to make contact with a conducting point 140 of the terminal 14.

The main body 11 of the housing 10 comprises a spring slot 15 and a press button slot 16 in communication with the spring slot 15. The spring slot 15 and the press button slot 16 are formed and defined by partition blocks 110 and 111. The press button slot 16 is provided at the outer edge thereof with a slot port 17 provided with two arresting portions 170 located respectively on the walls of the slot port 17.

The press button 50 has a shape corresponding to the shape of the press button slot 16 and has two restrictive flanges 51 located respectively on the two opposite sides of the inner end of the press button 50. Located in the inner end of the press button 52 is an insertion hole 52 facing the insulation piece 20. The press button 50 is further provided radially with a nail hole 53 passing through and normal to the insertion hole 52.

The insulation piece 20 has a serrated portion 23, which faces the press button 50 and has a locating hole 22 so dimensioned as to receive therein a nail 54 passing through the nail hole 53 of the press button 50.

The compression spring 40 is arranged in the spring slot is of the main body 11 of the housing 10 in such a manner that the compression spring 40 is fitted over the serrated portion 23 of the insulation piece 20, which is inserted into the insertion hole 52 of the press button 50 and is held secruely in place by means of the nail (or a rivet) passing through the nail hole 53 of the press button 50 and the locating hole 22 of the insulation piece 20. As a result, the press button 50 is disposed in the press button slot 16 of the main body 11 of the housing 10 in a manner that the outer end of the press button 50 is positioned outside the main body 11 through the slot port 17, and that the inner end of the press button 50 is urged by the compression spring 40.

Figure 3:
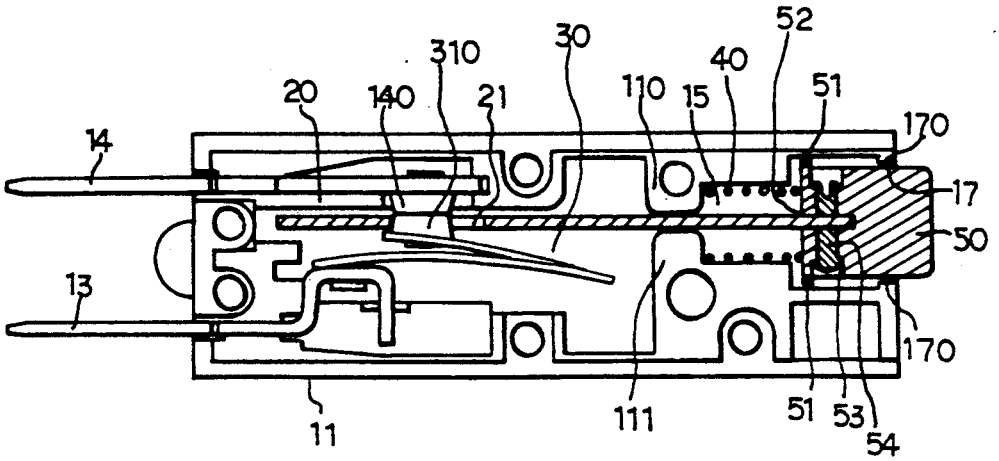
FIG. 3 is a sectional schematic view of the present invention in combination, showing that the insulation piece is not in a tripped state.
Figure 4:
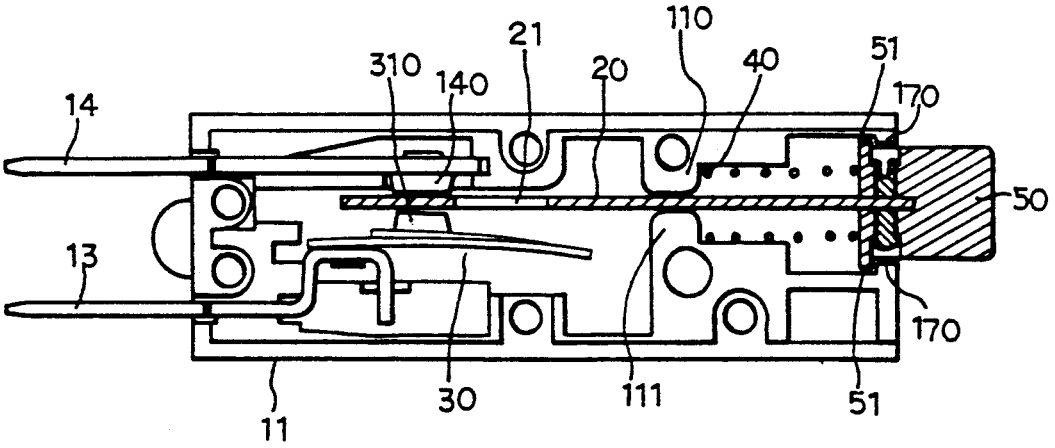
FIG. 4 is a sectional schematic view of the present invention in combination, showing that the insulation piece is in a tripped state.
Figure 6:
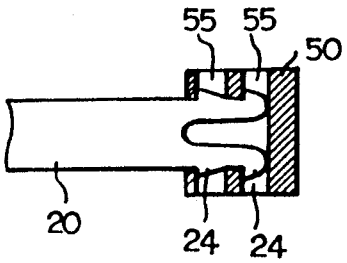
FIG. 6 is a schematic view of another preferred embodiment of the present invention, showing the way by which the press button is united with an end portion of the insulation piece.

A current overload generates a heat, which causes the distortion of the bimetallic blade 30, which in turn results in the departure of the contact 310 of the contact piece 31 from the through hole 21 of the insulation piece 20, as shown in FIG. 4. With the help of the elastic force of the compression spring 40, the insulation piece 20 exerts a pressure on the press button 50, which is then forced to move outwards until such time when the restrictive flanges 51 of the press button 50 are obstructed by the two arresting portions 170 of the slot port 17. As a result, the circuit is effectively protected. As soon as the factor responsible for the current overload is removed to bring about a drop in the temperature of the bimetallic blade 30, the press button 51 is pressed so as to cause the contact 310 of the contact piece 31 to make contact with a conducting point 140 of the terminal 14 by passing through the through hole 21 of the insulation piece 20. The circuit protecting device is therefore again in a state of being on the alert for another incident of current overload, as shown in FIG. 3.

The compression spring 40 of the present invention is held securely by the insulation piece 20 and is housed securely in the spring slot 15 of the main body 11 of the housing 10. Therefore, the spring 40 is not susceptible to an incident in which the spring 40 trips. Moreover, the spring 40 and the insulation piece 20 of the present invention are so aligned as to prevent the spring 40 from being bent during the process of installing the spring 40.

Figure 5:
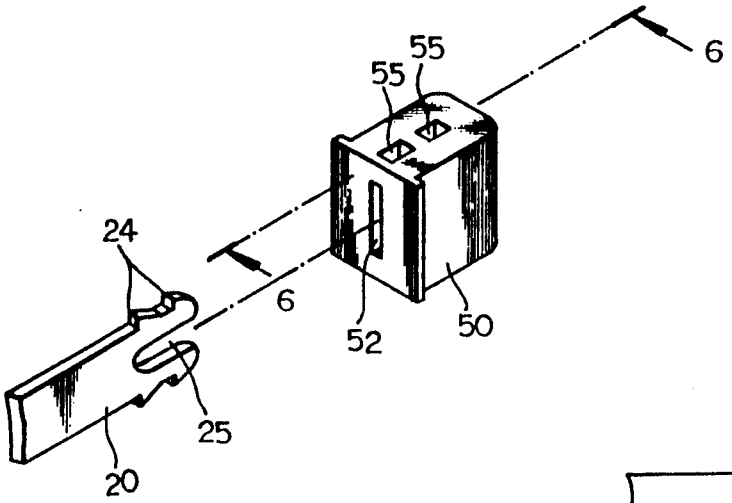
FIG. 5 is a schematic view of another preferred embodiment of the present invention, showing the way by which the press button is united with an end portion of the insulation piece.

As shown in FIG. 5, 6 the coupling of the press button 50 and the insulation piece 20 may be accomplished by some other technique, which involves the construction of a predetermined number of the inverted retaining holes 55 located radially in the press button 50, and which involves the construction of the unidirectional bevel retainers 24 which is located at an end of the insulation piece and is corresponding in number to the inverted retaining holes 55. In addition, a notch 25 is constructed in the body portion of the insulation piece 20 so as to facilitate the insertion of the insulation piece 20 into the insertion hole 52 of the press button 50 in a manner that the unidirectional bevel retainers 24 of the insulation piece 20 engage the inverted retaining holes 55 of the press button 50.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the hereinafter appended claims.

What is claimed is:

1. A circuit protecting device comprising a housing, an insulation piece, a bimetallic blade, a biasing means and a press button, with said housing having a cover and a main body housing therein two terminals, said insulation piece, said bimetallic blade, said biasing means and said press button, said bimetallic blade having an end that is fastened to one of said two terminals and having another end provided with a contact piece passing a through hole of said insulation piece to make contact with another one of said two terminals; therein said main body of said housing is characterized in that said main body comprises two partition blocks forming a biasing means slot and a press button slot communicating with said biasing means slot, with said press button slot dimensioned to receive therein said press button, and that said press button slot is provided with a slot port having two arresting portions located on two vertical sides of an outer end of said slot port for obstructing two restrictive flanges located on two vertical sides of an inner end of said press button, and further that said biasing means slot of said main body receives therein said biasing means in a manner that said biasing means embraces an outer end of said insulation piece which is inserted into an insertion hole of said press button received in said press button slot of said main body.

2. The circuit protecting device of claim 1 wherein said press button is provided with at least a nail hole normal to said insertion hole of said press button, with said nail hole in alignment with a locating hole situated at said outer end of said insulation piece.

3. The circuit protecting device of claim 1 wherein said insertion hole of said press button is so dimensioned as to receive securely said outer end of said insulation piece, with said outer end of said insulation piece being serrated.

4. The circuit protecting device of claim 1 wherein said press button is provided with at least an inverted retaining hole located over an upper side of said insertion hole of said press button or under a lower side of said insertion hole of said press button; wherein said outer end of said insulation piece is provided with at least a unidirectional bevel retainer corresponding in number to said inverted retaining hole of said press button, with said inverted retaining hole engaging said unidirectional bevel retainer at such time when said press button is coupled with said insulation piece; and wherein said outer end of said insulation piece is further provided with a notch to facilitate an easy entry of said outer end of said insulation piece into said insertion hole of said press button.

* * * * *